US011920357B2

(12) United States Patent
Smith

(10) Patent No.: US 11,920,357 B2
(45) Date of Patent: Mar. 5, 2024

(54) PLATFORM STRINGER AND DECK SUPPORT FRAME

(71) Applicant: David Smith, Mayfield, KY (US)

(72) Inventor: David Smith, Mayfield, KY (US)

(73) Assignee: RWS DESIGN AND CONTROLS, INC., Roscoe, IL (US)

( * ) Notice: Subject to any disclaimer, the term of this patent is extended or adjusted under 35 U.S.C. 154(b) by 117 days.

(21) Appl. No.: 16/887,261

(22) Filed: May 29, 2020

(65) Prior Publication Data

US 2021/0372142 A1 Dec. 2, 2021

(51) Int. Cl.
*E04F 15/02* (2006.01)

(52) U.S. Cl.
CPC .. *E04F 15/02183* (2013.01); *E04F 15/02044* (2013.01); *E04F 2015/02094* (2013.01)

(58) Field of Classification Search
CPC ..... E04F 15/02183; E04F 15/02044; E04F 2015/02094; E04F 15/0205; E04F 15/02055
See application file for complete search history.

(56) References Cited

U.S. PATENT DOCUMENTS 1,311,337 A * 7/1919 Fredson ..... A63H 33/06 446/114
1,325,792 A * 12/1919 Lachman ..... E04C 2/08 29/897.15
1,734,660 A * 11/1929 Brailey ..... E04C 2/425 52/669
1,867,702 A * 7/1932 Xeown ..... E04C 2/423 52/667
1,995,496 A * 3/1935 Burgess ..... E01D 19/125 193/41
2,006,929 A * 7/1935 Nagin ..... E04C 2/423 29/897.15
2,317,174 A * 4/1943 Bunker ..... E04C 2/423 52/669
2,320,292 A * 5/1943 Nelson ..... A63H 33/108 446/125
2,396,735 A 3/1946 Leigh
2,601,082 A * 6/1952 Ashman ..... E04B 5/36 52/336
2,652,133 A 9/1953 Leigh
2,656,903 A * 10/1953 Kerrigan, Jr. ..... B61D 17/14 105/457

(Continued)

FOREIGN PATENT DOCUMENTS

JP 2000257078 A * 9/2000
JP 2006241720 A * 9/2006

(Continued)

*Primary Examiner* — Phi D A
(74) *Attorney, Agent, or Firm* — Reinhart Boerner Van Deuren P.C.

(57) ABSTRACT

A stringer for a decking support frame, the stringer including a structural body having a front side, a back side, a top side, and a bottom side. The structural body also includes a plurality of weld free mounting tabs integral with the structural body extending from the top side and away from the bottom side. A plurality of apertures extend evenly spaced along a longitudinal length of the structural body and each aperture extends completely through the front side to the back side.

20 Claims, 4 Drawing Sheets

(56) References Cited

U.S. PATENT DOCUMENTS 2,751,706 A * 6/1956 Metal ..... A63H 33/06 211/186
2,767,627 A * 10/1956 Lynn ..... E04C 2/423 52/668
2,830,509 A * 4/1958 Bustin ..... E04C 2/426 52/180
4,037,383 A * 7/1977 Diebold ..... E04C 2/425 52/664
4,198,034 A * 4/1980 Svirklys ..... E04H 17/1447 256/72
4,282,695 A * 8/1981 Lew ..... E04C 2/422 52/664
4,309,125 A * 1/1982 Richardson ..... E01D 19/125 52/447
4,761,930 A * 8/1988 Tepera ..... E04C 2/423 52/664
4,858,399 A * 8/1989 Salato, Jr. ..... E04B 1/003 52/97
4,976,221 A * 12/1990 Yetter ..... A01K 1/0151 119/509
5,069,778 A * 12/1991 Lower ..... B07B 1/12 209/323
5,083,996 A * 1/1992 Smith ..... B65D 19/0095 29/453
5,394,667 A * 3/1995 Nystrom ..... E01D 19/125 52/263
5,427,019 A * 6/1995 Moorman ..... B65D 19/0026 108/51.3
5,553,421 A * 9/1996 Stratford ..... E06C 1/38 182/228.1
5,950,377 A * 9/1999 Yoder ..... E04F 15/10 52/177
6,018,833 A * 2/2000 Imm ..... E01D 19/125 14/73
6,244,013 B1 * 6/2001 Lee ..... E06B 9/01 49/50
6,286,284 B2 * 9/2001 Cantley ..... E04C 2/427 52/311.1
7,549,260 B2 * 6/2009 Shepherd ..... B23P 15/12 403/364
8,336,278 B2 * 12/2012 Smith ..... E04F 15/10 52/747.12
8,747,018 B2 * 6/2014 Smith ..... E01C 5/00 404/29
9,394,078 B1 * 7/2016 Roberts ..... B65D 19/0073
10,184,239 B2 1/2019 Meincke et al.
2001/0029706 A1 * 10/2001 Risser ..... E04B 1/003 52/11
2003/0066260 A1 * 4/2003 Shepherd ..... E04C 2/423 404/90
2006/0218872 A1 * 10/2006 Bigott ..... E04C 2/423 52/660
2006/0242916 A1 * 11/2006 Simko ..... E04F 19/061 52/177
2009/0077758 A1 * 3/2009 Vincent ..... E01D 22/00 14/73
2012/0234737 A1 * 9/2012 Connolly ..... B07B 1/4645 209/405
2012/0311952 A1 * 12/2012 Campbell-Lloyd ..... E04F 15/02022 52/586.2
2017/0275050 A1 * 9/2017 Pang ..... B65D 19/0095
2019/0186131 A1 * 6/2019 Penewell ..... E04B 5/023
2019/0338530 A1 * 11/2019 Winter ..... E04F 11/112
2020/0407982 A1 * 12/2020 Schneider ..... E04B 1/003

FOREIGN PATENT DOCUMENTS

KR 101414791 B1 * 3/2014
KR 101426758 B1 * 5/2014
KR 101693343 B1 * 5/2017
KR 20170025811 A * 10/2017
KR 101900790 B1 * 9/2018

* cited by examiner

PLATFORM STRINGER AND DECK SUPPORT FRAME

FIELD OF THE INVENTION

This invention generally relates to modular working platforms, the structural support members therefore, and the methods for the assembly thereof. More specifically, the invention relates to platform stringers, deck support frames, and methods of assembly of the deck support frames with the stringers to construct a modular working platform.

BACKGROUND OF THE INVENTION

Modular working platforms generally surround large machinery in the manufacturing industry and the food processing industry. Such platforms are assembled on site. The platforms are generally comprised of support frames, the number and arrangement of which depend upon the size of the machine they are intended for. The support frames of the platforms support decking, that is flooring, that permit operators to walk on the decking. Such platforms, frames and the decking thereon are constructed in light of operator safety concerns. Additionally, at least in the food processing industry, such platforms must meet sanitary conditions. Typically, such platforms are assembled around an existing machine, device, or apparatus. These conventional platform installations utilize square or rectangular structural members to build a support frame to install decking on a walking surface. These conventional structures require structural welds at each joint in the support frame. Further, individual tabs must be welded on to the frame to support the decking thereon.

Other platforms use round material for structural members to build the support frame. Such round members may be more sanitary, because the round members do not have "sides" but arcs that permit easy run off of materials that could possibly accumulate thereon. However, such round structural members still require structural welds at each joint and require the expensive and time consuming process of welding tabs on the upper surface of the frame in order to support the decking that operators walk upon when on the platform.

Yet other platforms utilize square or rectangular structural members turned on a 45 degree angle to build the support frame. This method may be more sanitary than the rectangular structural members, as the edge, prevents the accumulation of material thereon. However, the use of such angled structural members are difficult to cut and prepare and require many structural welds, including welding tabs thereon to support decking installed thereon.

BRIEF SUMMARY OF THE INVENTION

Embodiments of the instant invention provide for simple and cost effective stringers, decking support frames, and methods for assembly of the deck frame with the structural support members of the stringers and cross members for a platform. The embodiments provide sanitary construction methods, structural integrity, and ease of installation together. Large structural materials are able to be integrated together in a way that reduces installation time by producing a more efficient method of joining structural materials.

In addition, embodiments provide for a stringer that incorporates weld free tabs that are used to mount steel decking into the stringer thus saving time, labor costs and the elimination of complex structural welds where cross members pass through the stringer. The weld free tabs, may also provide an important structural improvement over prior welded tabs as the monolithic construction with the stringer body improves strength and provides for the possibility of pitched decking with much greater precision and lower installation time and costs than tabs cut and welded in place during assembly.

More specifically, embodiments of the invention provided a stringer that includes a structural body having a front side, a back side, a top side, and a bottom side. A plurality of weld free mounting tabs are integral with the structural body extending from the top side and away from the bottom side. By integral it means the structural body is monolithic such that it is free of any welds or other bonding materials such that it is a single piece of material fabricated from a single sheet or blank. A plurality of apertures extend evenly spaced along a longitudinal length of the structural body and each aperture extends completely through the front side to the back side as a through hole.

In yet another aspect of the invention, a decking support frame is provided. The decking support frame includes at least two stringers. Each stringer includes a structural body having a front side, a back side, a top side, and a bottom side. A plurality of weld free mounting tabs are integral with the structural body and extend from the top side and away from the bottom side. A plurality of apertures extend evenly spaced along a longitudinal length of the structural body and each aperture extends completely through the front side to the back side. The decking support frame also includes at least two cross members. Each one of the at least two cross members passes through at least one of the plurality of apertures of each one of the at least two stringers to form the decking support frame.

In an embodiment, a member width is defined between the front and back side. A mounting tab width of each one of the plurality of weld free mounting tabs is the same as the member width.

In an embodiment, a plurality of planar surfaces extend from a left side of the structural body to a right side of the structural body and between any pair of any two adjacent weld free mounting tabs.

In an embodiment, each one of the plurality of apertures is square.

In an embodiment, each one of the plurality of apertures is round.

In an embodiment, each one of the plurality of apertures is rectangular.

In an embodiment, each one of the plurality of apertures is a square turned at a 45 degree angle relative to a longitudinal axis of the structural body of the stringer.

In an embodiment, each one of the plurality of weld free mounting tabs is rectangular in shape.

In an embodiment, each one of the plurality of weld free mounting tabs is a different height than every other one of the plurality of weld free mounting tabs.

In an embodiment, the structural body further comprises a left and right side. The front and rear sides extend between the left and right sides. The plurality of weld free mounting tabs extend in a tapered profile from the left to the right side.

In an embodiment, the bottom side is a planar surface extending the entire length of the front and back sides.

In an embodiment, each one of the plurality of apertures is round and the at least two cross members are round.

In an embodiment, a cross section of the structural body is rectangular in shape.

In an embodiment, fillet welds bond the plurality of apertures with the at least two cross members passing therethrough.

In an embodiment, the plurality of apertures are square and the at least two cross members are square.

In yet another aspect, the invention provides a method for constructing a decking support frame. The method includes the steps of providing at least two stringers. Each stringer includes a structural body having a front side, a back side, a top side, and a bottom side. A plurality of weld free mounting tabs are integral with the structural body and extend from the top side and away from the bottom side. A plurality of apertures extend evenly spaced along a longitudinal length of the structural body and each aperture extends completely through the front side to the back side. The method includes the step of inserting a first cross member through a first one of the plurality of apertures of each one of the at least two stringers. The method includes the step of inserting a second cross member through a second one of the plurality of apertures of each one of the at least two stringers to form the decking support frame.

In an embodiment of the method, a further step includes welding the first and second cross members where they pass through the first and second stringers with only fillet welds.

In an embodiment of the method, the step of providing the at least two stringers further comprises the step of providing the plurality of apertures as one of a round aperture, a square aperture, a rectangular aperture and an aperture rotated 45 degrees relative to a longitudinal axis of the structural body.

In an embodiment of the method, the step of providing the first and second cross members further comprises the step of providing a one of a round cross member, a rectangular cross member, and a square cross member an cross member rotated 45 degrees relative to longitudinal axis of the structural body.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
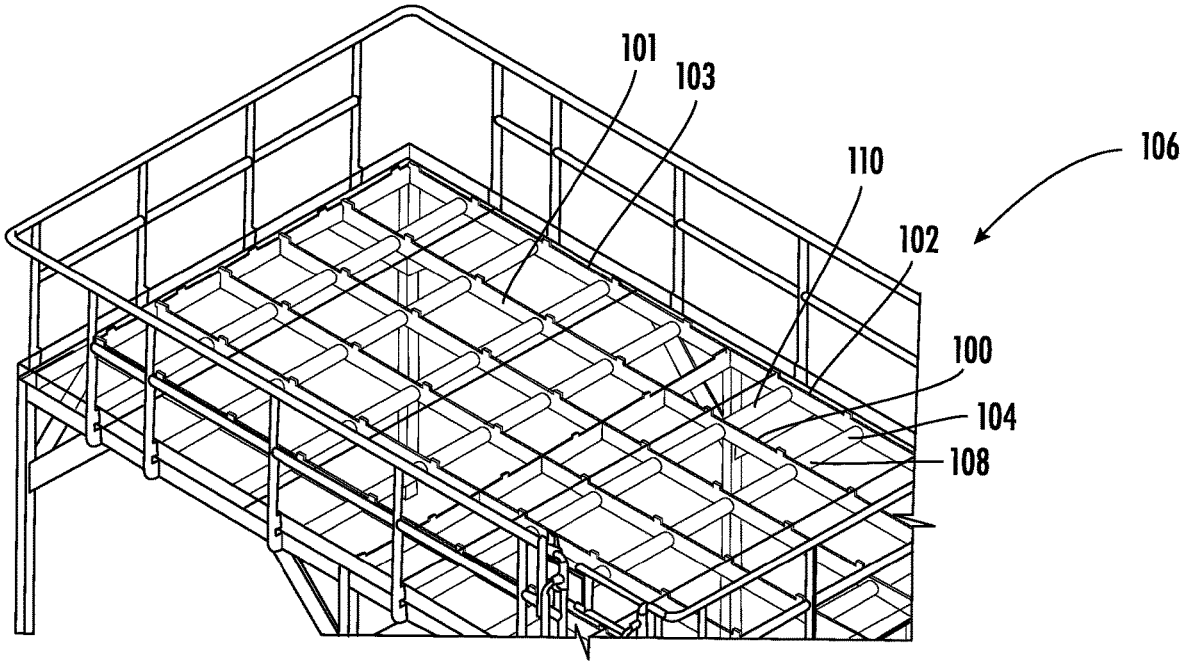
FIG. 1 is an isometric view of a modular working platform with a stringer and decking support frame according to the teachings of the instant disclosure.

Turning now to the drawings, there is illustrated in FIG. 1 an exemplary embodiment of a stringer 100 and stringer 102 forming part of a decking support frame 104 of a modular working platform 106. At least two cross members 108, 110 pass through the stringers 100, 102 in order to form the decking support frame 104. The cross members 108, 110 illustrated are round. However, other examples, as will be discussed below may provide for square, rectangular, or angled shapes. A plurality of decking support frames 104 make up the modular working platform 106. The decking support frames 106 support deck plates (not illustrated) that are placed over the decking support frame 104 to provide a walking surface for operators on the modular working platform 106. Generally, the deck plates are welded in place, however, alternative mounting may be used, for example with various fasteners.

In an example, the decking support frame 104, made up of the at least two stringers 100, 102 and the two cross members 108, 110 are made of stainless steel, typically type 304 stainless steel or type 316 stainless steel. Such stainless steel is typically used around equipment requiring sanitary conditions, for example, in food processing plants. However, in other embodiments where such sanitary conditions may not be required, other steels or composites or other suitable materials may be used to construct the decking support frame 104.

The spacing between the stringers 100, 102 and the spacing between the two cross member 108, 110 determine the area of any single decking support frame 104. The overall length of the two cross members 108, 110 can determine the length of the modular working platform. Additional stringers 101, 103, and so on, may be welded or otherwise secured to the ends of the stringers 100, 102, so as to increase the length of the modular working platform 106.

Figure 2:
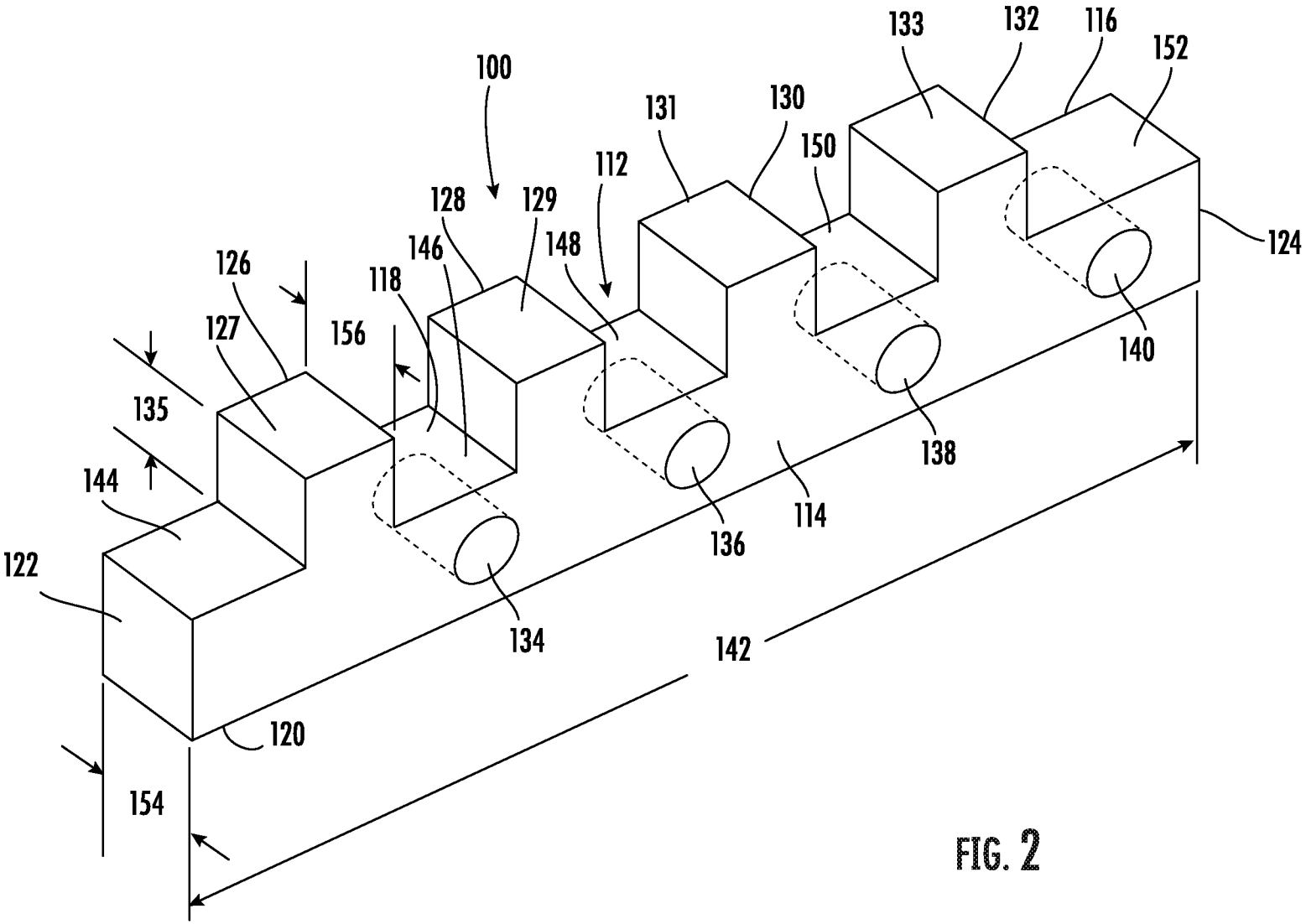
FIG. 2 is a schematic isometric view of a stringer of the decking support frame of FIG. 1.

Turning then to FIG. 2, stringer 100 is illustrated. The stringer 100 has a structural body 112 with a front side 114, a back side 116, a top side 118, a bottom side 120, a left side 122, and a right side 124. The stringer 100 includes a plurality of weld free mounting tabs 126, 128, 30, 132 integral with the structural body 112 and extending from the top side 114 and away from the bottom side 120 to provide for a same height 135 above the top side 114. In other embodiments discussed below (FIG. 5) the height 135 may differ between each respective weld free mounting tab 126, 128, 30, 132 to provide for a pitch when the decking (not illustrated) is received by the weld free mounting tab 126, 128, 30, 132.

The monolithic, single unitary piece construction of the stringer 100 with its weld free mounting tabs 126, 128, 30, 132 is typically done via laser cutting of the structural body 112 from stock material. By integral it means the structural body 113 is monolithic such that it is free of any welds or other bonding materials such that it is a single piece of material fabricated from a single sheet or blank. Such weld free mounting tabs 126, 128, 130, 132 provide an important structural improvement over prior welded tabs as the monolithic construction with the stringer body 112 improves strength particularly over a weldment or other fastener or bonding/joining means.

However, it is not the intent to limit the fabrication of the stringer 100 to laser cutting as other forming methods including other thermal methods are possible. By way of non-limiting examples, plasma cutting, oxy-fuel cutting, and non-thermal methods may be used, for e.g. typical material removal such as various cutting machine tools and cold working methods such as stamping. Each one of the plurality of weld free mounting tabs 126, 128, 130, 132 are generally rectangular in shape to permit the generally planar decking (not illustrated) to receive a top planar surface 127, 129, 131, 133 of each one of the plurality of weld free mounting tabs 126, 128, 130, 132. It is not the intent to limit the tabs to the rectangular shape as other shapes are possible, for example square shapes or shapes with a tapered top surface to provide a pitch (see FIG. 5).

A plurality of apertures 134, 136, 138, 140 extend evenly spaced along a longitudinal length 142 of the structural body 112. Each aperture 134, 136, 138, 140 extends completely through the front side 114 to the back side 116. A plurality of planar surfaces 144, 146, 148, 150, 152 extend from the left side 122 to the right side 124. More specifically, from the left side 122 to the firs weld free mounting tab 126 there is a planar surface 144. Thereafter, between each pair of adjacent weld free mounting tabs 126, 128, and 128, 130, and 130, 132 there is a planer surface, 146, 148, and 150 respectively, and then from the last weld free mounting tab 132 to the right side 124 there is a planar surface 152. The bottom side 120 is an entirely planar surface extending from the left side 122 to the right side 124.

Figure 10:
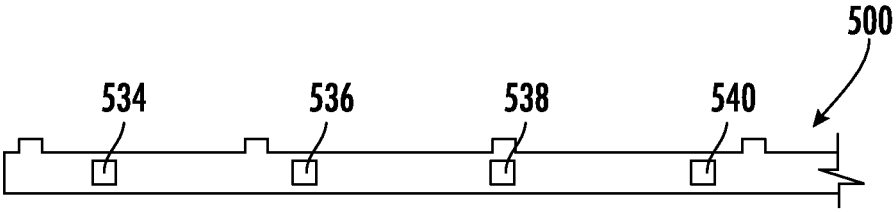
FIG. 10 is a front view of a fifth embodiment of a stringer with cross members therethrough.

It is not the intent to limit the number of weld free mounting tabs 126, 128, 130, 132 to four or the number of apertures 134, 136, 138, 140 to four or the number of planer surfaces 144, 146, 148, 150, 152 along the top side 118 to five. Instead, the stringer 100 may be sized according to need based on the desired size of the modular working platform 106 (FIG. 1) and deck support frame 104 (FIG. 10). Thus, in the example shown in FIG. 2, it can now be readily appreciated that there may be more or less weld free mounting tabs 126, 128, 130, 132 and apertures 134, 136, 138, 140, and planar surfaces 144, 146, 148, 150, 152 depending on the size of the stringer 100 that is desired.

Still with respect to FIG. 2, a member width 154 of the structural body 112 is defined between the front side 114 and back side 116. A mounting tab width 156 of each of the weld free mounting tabs 126, 128, 130, 132 is the same as the member width 154.

Figure 3:
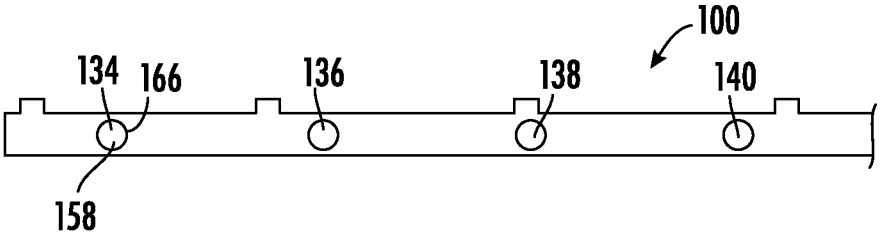
FIG. 3 is a front view of the stringer of FIG. 1 with cross members therethrough.
Figure 4:
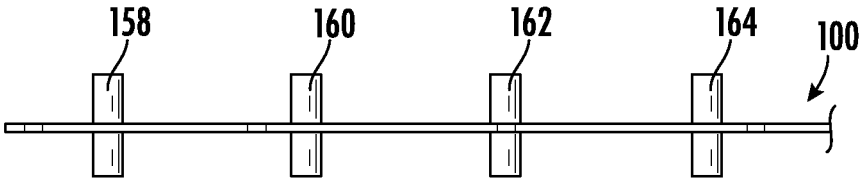
FIG. 4 is a top view of the stinger of FIG. 1 with cross members therethrough.

Turning now to FIG. 3 and FIG. 4, a front view of the stringer 100 is shown with the plurality of apertures 134, 136, 138, 140, that are circular and the cross members 158, 160, 162, 164 therethrough. FIG. 4 is a top view of the stringer 100 which also shows the plurality of cross members 158, 160, 162, 164 that are circular and extend through the plurality of apertures 134, 136, 138, 140. Once the plurality of cross members 158, 160, 162, 164 are in place through the plurality of apertures 134, 136, 138, 140 a fillet weld 166 is placed around each of the plurality of cross members 158, 160, 162, 164 at the intersection with each respective one of the plurality of apertures 134, 136, 138, 140.

By passing the plurality cross members 158, 160, 162, 164 through the apertures 134, 136, 138, 140 with a close tolerance the fillet weld 166 may be used thereby eliminating the complexity of the weld for faster construction. Indeed, the need for structural welds at the intersection of the stringer 100 at the apertures 134, 136, 138, 140 and the cross members 158, 160, 162, 164 is no longer necessary, thereby decreasing costs with decreased labor and welding material because of the less complex and less time consuming fillet welds 166 may be used. Such fillet welds 166 eliminate the need for multiple step process of the structural weld comprising for example a first pass followed by a cover pass.

Figure 5:
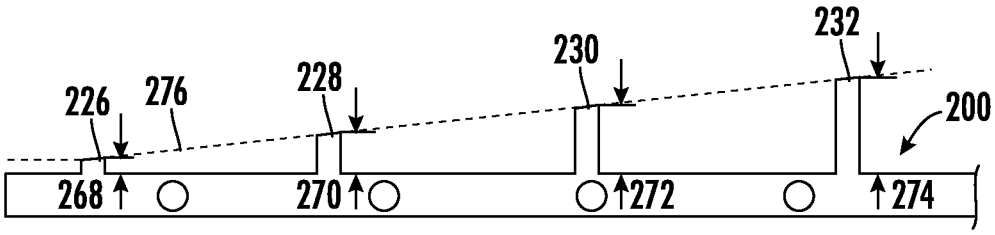
FIG. 5 is a front view of second embodiment of a stinger with cross members therethrough.

FIG. 5 illustrates a second embodiment of a stringer 200. Stringer 200 is the same as previously described stringer 100 except for the following. A plurality of weld free tabs 226, 228, 230, 232 each have an increasing height 268, 270, 272, 274 from the left side 222 to the right side 224 such that a pitch 276 is created when deck plates (not illustrated) are received by the plurality of weld free tabs 226, 228, 230, 232. It can now be readily appreciated that any desired pitch 276 or pitches are easily provided for by having fabricated the stringer 200 off site where precise heights of the plurality of weld free tabs 226, 228, 230, 232 can be easily made. The top surfaces of each of the tabs 226, 228, 230, 232 may tapered to create the desired pitch 276.

Figure 6:
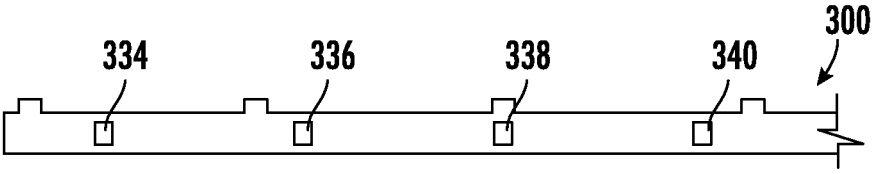
FIG. 6 is a front view of a third embodiment of a stringer with cross members therethrough.
Figure 7:
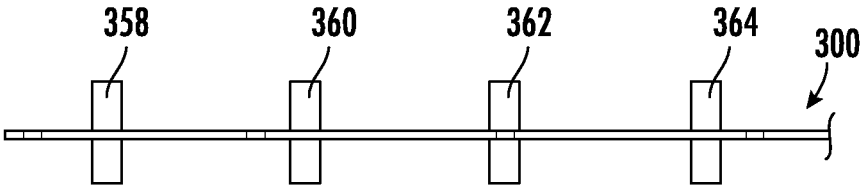
FIG. 7 is a top view of the third embodiment of the stringer with cross members therethrough.

FIG. 6 and FIG. 7 illustrate, respectively, a front view and a top view of a third embodiment of a stringer 300 according to the teachings of this disclosure. Stringer 300 is the same as stringer 100 except that rectangular cross members 358, 360, 362, 364 pass through rectangular apertures 334, 336, 338, 340.

Figure 8:
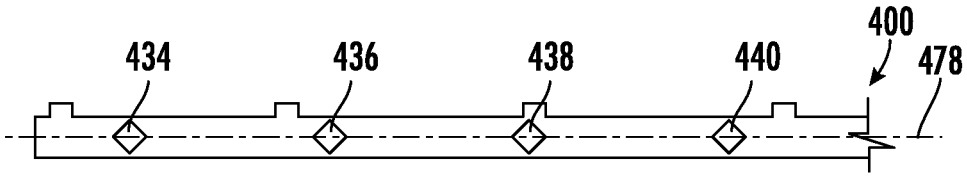
FIG. 8 is a front view of fourth embodiment of a stinger with cross members therethrough.
Figure 9:
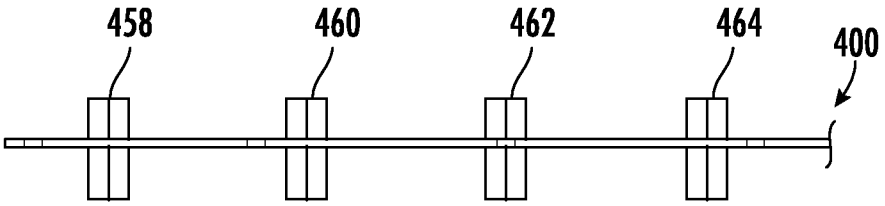
FIG. 9 is a top view of the fourth embodiment of the stinger with cross members therethrough.

FIGS. 8 and 9 illustrate a front view and a top view of a fourth embodiment of a stringer 400. Stinger 400 is the same as stringer 100 except that square cross members squares are turned at a 45 degree angle relative to the longitudinal axis 478 to pass through square apertures 434, 436, 438, 440 turned at a 45 degree angle relative to the longitudinal axis 478.

Figure 11:
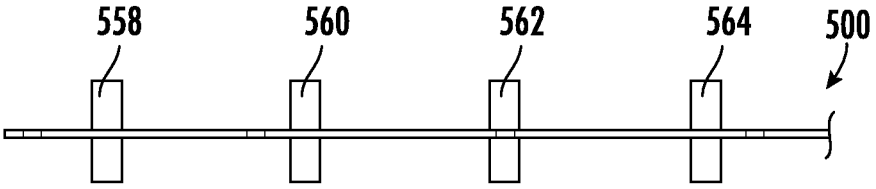
FIG. 11 is a top view of the fifth embodiment of the stringer with cross members therethrough.

FIGS. 10 and 11 illustrate a front view and a top view of a fifth embodiment of a stringer 500 according to the teachings of this disclosure. Stringer 500 is the same as stringer 100 except that rectangular cross members 558, 560, 562, 564 pass through rectangular apertures 534, 536, 538, 540.

In light of the foregoing, it can now be readily understood that the stringers 100, 200, 300, 400, 500 allows the end user to marry sanitary construction methods, structural integrity, and ease of installation together. The stringers 100, 200, 300, 400, 500, allow the end user to integrate large structural materials together e.g. cross members 156, 158, 160, 162, 164 and those of the other disclosed embodiments such as in a way that reduces installation time by producing a more efficient method of joining the stringers 100, 200, 300, 400, 500 and the cross members e.g. 156, 158, 160, 162, 164. In addition, the stingers 100, 200, 300, 400, 500, incorporate the weld free mounting tabs (e.g. 126, 128, 130, 132) used to receive the steel decking (not illustrated) thus saving additional welding. The elevation of the weld free mounting tabs e.g. 126, 128, 130, 132 can also be modified to allow for creating a pitch e.g. 276 (FIG. 5) on the steel decking after installation.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A stringer for a decking support frame, the stringer comprising:

a structural body having a front side, a back side, a top side, and a bottom side;

a plurality of weld free mounting tabs integral with the structural body extending from the top side and away from the bottom side; and wherein a plurality of apertures are a complete circle or triangular or rectangular and extend evenly spaced along a longitudinal length of the structural body and each aperture extends completely through the front side to the back side, and each aperture is completely surrounded by the structural body;

wherein each one of the plurality of weld free mounting tabs is generally rectangular and defines a planar top surface with all sides of the mounting tab extending normal from the planar top surface, the planar top surface configured to receive steel deck decking;

wherein each one of the plurality of weld free mounting tabs has a length extending in a direction parallel to the longitudinal length of the structural body; and wherein a distance extending between two adjacent ones of the plurality of weld free mounting tabs along the longitudinal length is greater than the length of each one of mounting tabs;

wherein a member width is defined between the front and back side and a mounting tab width of each one of the plurality of weld free mounting tabs is the same as the member width.

2. The stringer of claim 1, wherein a plurality of planar surfaces extend from a left side of the structural body to a right side of the structural body and between any pair of adjacent weld free mounting tabs.

3. A stringer for a decking support frame, the stringer comprising:

a structural body having a front side, a back side, a top side, and a bottom side;

a plurality of weld free mounting tabs integral with the structural body extending from the top side and away from the bottom side; and wherein a plurality of apertures are a complete circle or triangular or rectangular and extend evenly spaced along a longitudinal length of the structural body and each aperture extends completely through the front side to the back side, and each aperture is completely surrounded by the structural body;

wherein each one of the plurality of weld free mounting tabs is generally rectangular and defines a planar top surface with all sides of the mounting tab extending normal from the planar top surface, the planar top surface configured to receive steel deck decking;

wherein each one of the plurality of weld free mounting tabs has a length extending in a direction parallel to the longitudinal length of the structural body; and wherein a distance extending between two adjacent ones of the plurality of weld free mounting tabs along the longitudinal length is greater than the length of each one of mounting tabs;

wherein each one of the plurality of apertures is square.

4. A stringer for a decking support frame, the stringer comprising:

a structural body having a front side, a back side, a top side, and a bottom side;

a plurality of weld free mounting tabs integral with the structural body extending from the top side and away from the bottom side; and wherein a plurality of apertures are a complete circle or triangular or rectangular and extend evenly spaced along a longitudinal length of the structural body and each aperture extends completely through the front side to the back side, and each aperture is completely surrounded by the structural body;

wherein each one of the plurality of weld free mounting tabs is generally rectangular and defines a planar top surface with all sides of the mounting tab extending normal from the planar top surface, the planar top surface configured to receive steel deck decking;

wherein each one of the plurality of weld free mounting tabs has a length extending in a direction parallel to the longitudinal length of the structural body; and wherein a distance extending between two adjacent ones of the plurality of weld free mounting tabs along the longitudinal length is greater than the length of each one of mounting tabs;

wherein each one of the plurality of apertures is round.

5. The stringer of claim 1, wherein each one of the plurality of apertures is rectangular.

6. The stringer of claim 1, wherein the bottom side is a planar surface extending the entire length of the front and back sides.

7. A stringer for a decking support frame, the stringer comprising:

a structural body having a front side, a back side, a top side, and a bottom side;

a plurality of weld free mounting tabs integral with the structural body extending from the top side and away from the bottom side; and wherein a plurality of apertures are a complete circle or triangular or rectangular and extend evenly spaced along a longitudinal length of the structural body and each aperture extends completely through the front side to the back side, and each aperture is completely surrounded by the structural body;

wherein each one of the plurality of weld free mounting tabs is generally rectangular and defines a planar top surface with all sides of the mounting tab extending normal from the planar top surface, the planar top surface configured to receive steel deck decking;

wherein each one of the plurality of weld free mounting tabs has a length extending in a direction parallel to the longitudinal length of the structural body; and wherein a distance extending between two adjacent ones of the plurality of weld free mounting tabs along the longitudinal length is greater than the length of each one of mounting tabs;

wherein each one of the plurality of apertures is a square turned at 45 degree angle relative to a longitudinal axis of the structural body.

8. A stringer for a decking support frame, the stringer comprising:

a structural body having a front side, a back side, a top side, and a bottom side;

a plurality of weld free mounting tabs integral with the structural body extending from the top side and away from the bottom side; and wherein a plurality of apertures extend evenly spaced along a longitudinal length of the structural body and each aperture extends completely through the front side to the back side;

wherein each one of the plurality of weld free mounting tabs is a different height than every other one of the plurality of weld free mounting tabs.

9. The stringer of claim 8, wherein the structural body further comprises a left and right side, the front and rear sides extending therebetween, the plurality of weld free mounting tabs extending in a tapered profile from the left to the right side.

10. A decking support frame, the decking support frame comprising:

at least two stringers, each stringer comprising:

a structural body having a front side, a back side, a top side, and a bottom side;

a plurality of weld free mounting tabs integral with the structural body extending from the top side and away from the bottom side;

wherein a plurality of apertures are a complete circle or triangular or rectangular and extend evenly spaced along a longitudinal length of the structural body and each aperture extends completely through the front side to the back side, and each aperture is completely surrounded by the structural body;

at least two cross members;

wherein each one of the at least two cross members passes through at least one of the plurality of apertures of each one of the at least two stringers to form the decking support frame;

wherein each one of the plurality of weld free mounting tabs is generally rectangular and defines a planar top surface with all sides of the mounting tab extending normal from the planar top surface, the planar top surface configured to receive steel deck decking;

wherein each one of the plurality of weld free mounting tabs has a length extending in a direction parallel to the longitudinal length of the structural body; and wherein a distance extending between two adjacent ones of the plurality of weld free mounting tabs along the longitudinal length is greater than the length of each one of mounting tabs.

11. The decking support frame of claim 10, wherein each one of the plurality of apertures is round and the at least two cross members are round.

12. The decking support frame of claim 10, wherein a cross section of the structural body is rectangular in shape.

13. The decking support frame of claim 10, wherein only fillet welds bond the plurality of apertures with the at least two cross members passing therethrough.

14. The decking support from of claim 10, wherein the plurality of apertures are square and the at least two cross members are square.

15. A method for constructing a decking support frame, the method comprising the steps of:

providing at least two stringers, each stringer comprising:

a structural body having a front side, a back side, a top side, and a bottom side;

a plurality of weld free mounting tabs integral with the structural body extending from the top side and away from the bottom side; and wherein a plurality of apertures are a complete circle or triangular or rectangular and extend evenly spaced along a longitudinal length of the structural body and each aperture extends completely through the front side to the back side, and each aperture is completely surrounded by the structural body;

wherein each one of the plurality of weld free mounting tabs is generally rectangular and defines a planar top surface with all sides of the mounting tab extending normal from the planar top surface, the planar top surface configured to receive steel deck decking;

wherein each one of the plurality of weld free mounting tabs has a length extending in a direction parallel to the longitudinal length of the structural body;

wherein a distance extending between two adjacent ones of the plurality of weld free mounting tabs along the longitudinal length is greater than the length of each one of mounting tabs;

inserting a first cross member through a first one of the plurality of apertures of each one of the at least two stringers; and inserting a second cross member through a second one of the plurality of apertures of each one of the at least two stringers to form the decking support frame.

16. The method of claim 15, further comprising the step of welding at an intersection of the first and second cross members where they pass through the first and second stringers with only fillet welds.

17. The method of claim 15, wherein the step of providing the at least two stringers further comprises the step of providing the plurality of apertures as one of a round aperture, a square aperture, a rectangular aperture and an aperture rotated 45 degrees relative to a longitudinal axis of the structural member.

18. The method of claim 15, wherein the step of providing the first and second cross members further comprises the step of providing a one of a round cross member, a rectangular cross member, a rectangular cross member, a square cross member and a cross member rotated 45 degrees relative to a longitudinal axis of the structural body.

19. The method of claim 15, including the step of mounting a steel deck decking such that the steel deck decking bears against the planar top surface of the weld free mounting tabs; and the steel deck decking is spaced apart from and free from contact with the cross members.

20. A stringer for a decking support frame, the stringer consisting essentially of:

a structural body having a front side, a back side, a top side, and a bottom side;

a plurality of weld free mounting tabs integral with the structural body extending from the top side and away from the bottom side; and wherein a plurality of apertures are a complete circle or triangular or rectangular and extend evenly spaced along a longitudinal length of the structural body and each aperture extends completely through the front side to the back side, and each aperture is completely surrounded by the structural body;

wherein each one of the plurality of weld free mounting tabs is generally rectangular and defines a planar top surface with all sides of the mounting tab extending normal from the planar top surface, the planar top surface configured to receive steel deck decking;

wherein each one of the plurality of weld free mounting tabs has a length extending in a direction parallel to the longitudinal length of the structural body; and wherein a distance extending between two adjacent ones of the plurality of weld free mounting tabs along the longitudinal length is greater than the length of each one of mounting tabs.

* * * * *